2-10-76 XR 3,937,866

United States Patent [19]

Sunnen et al.

[11] 3,937,866

[45] Feb. 10, 1976

[54] PROCESS OF STRIKING AN ARC FOR A PLASMA BEAM INSIDE AN ENCLOSURE AND A STICK-ELECTRODE FOR CARRYING OUT THE PROCESS

[75] Inventors: Jean Albert Sunnen; Henry Rene Schoumaker, both of Brussels, Belgium

[73] Assignee: La Soudure Electrique Autogene, Procedes Arcos, Anderlecht, Belgium

[22] Filed: Sept. 3, 1974

[21] Appl. No.: 502,825

[30] Foreign Application Priority Data

Oct. 17, 1973 Belgium ..... 136776

[52] U.S. Cl. ..... 13/9 R; 219/121 P

[51] Int. Cl.[2] ..... H05H 1/26

[58] Field of Search ..... 13/1, 9, 10, 9 P; 219/121 P

[56] References Cited

UNITED STATES PATENTS

| | | | |
|---|---|---|---|
| 3,520,977 | 7/1970 | Petersen | 13/9 |
| 3,749,802 | 7/1973 | Camacho | 13/9 |
| 3,749,803 | 7/1973 | Camacho | 13/1 |
| 3,830,950 | 8/1974 | Schoumaker et al. | 13/9 |

*Primary Examiner*—R. N. Envall, Jr.
*Attorney, Agent, or Firm*—Jackson, Jackson & Chovanes

[57] ABSTRACT

A striking process for a plasma beam at high temperature which includes an enclosure between two torches located at opposite sides of the enclosure and outside the enclosure, a stick-electrode introduced lengthwise through a window of one of the torches and brought near the opposite torch until the plasma flame hooks to the stick-electrode, thereby closing between the nozzle and the stick-electrode the circuit of a superimposed current, then pulling the stick-electrode progressively from the enclosure, carrying with it the plasma beam until it meets a second torch which is energized at the very moment of extraction of the stick-electrode, and then disconnecting the stick and closing the laminar plasma flow circuit.

2 Claims, 9 Drawing Figures

FIG. I
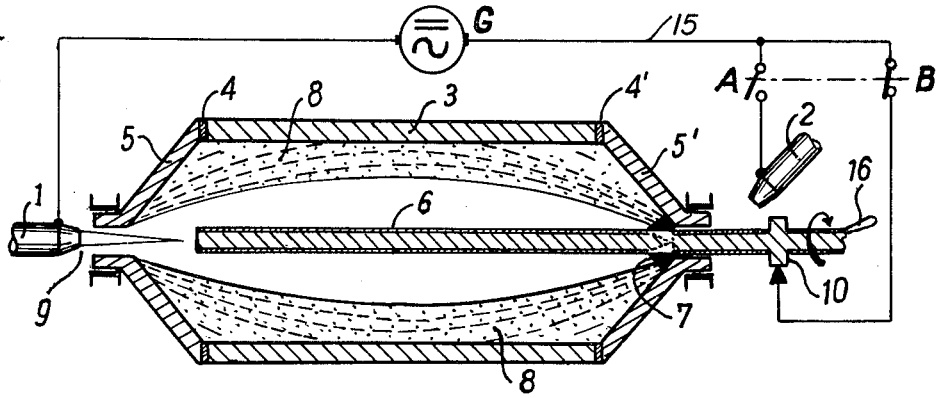
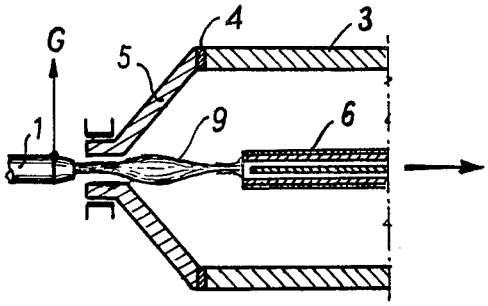
FIG II (a)
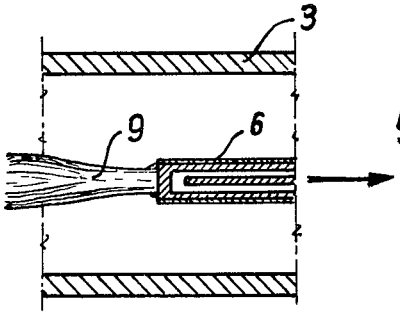
FIG II (b)
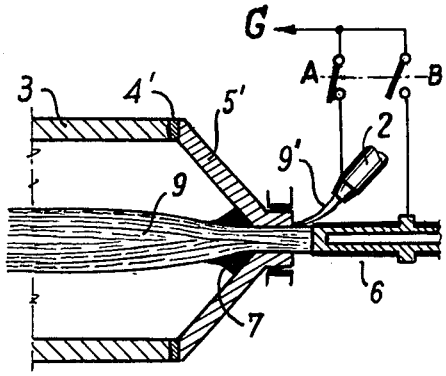
FIG II (c)

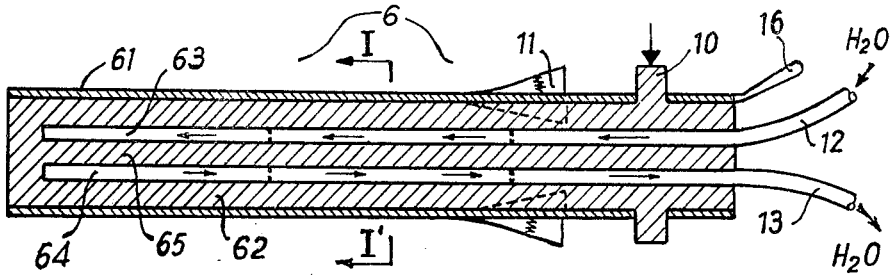
FIG. III (a)
FIG III (b)
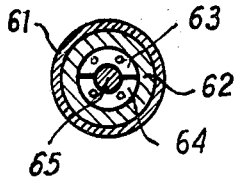
FIG. IV
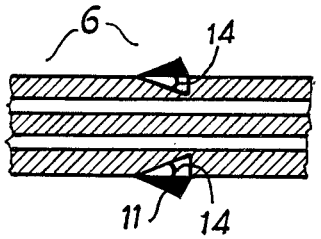
FIG. IV (a)
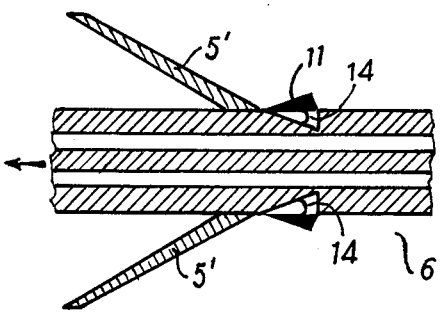
FIG IV (b)
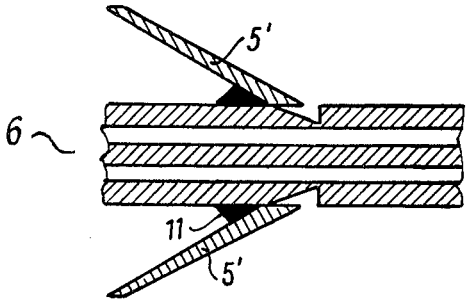

PROCESS OF STRIKING AN ARC FOR A PLASMA BEAM INSIDE AN ENCLOSURE AND A STICK-ELECTRODE FOR CARRYING OUT THE PROCESS

DISCLOSURE OF THE INVENTION

The present invention relates to creation of a high temperature plasma beam in an enclosure with laminar steady flow between plasma torches located at opposite ends of the enclosure. The invention relates particularly to the striking phase of the operation regardless of the ulterior exploitation of the thermal flow so created (oxidation by oxygen plasma, reduction by hydrogen plasma, refining, fusion, etc.)

The process and equipment claimed for that purpose are independent of the type of enclosure, but they prove to be particularly useful or even indispensable when the plasma torches are set at the ends of the elongated enclosure, outside it and facing orifices spread apart (more than 70 cm) to such an extent that an energetic superimposed electric current cannot pass immediately, even though the plasma beam is expected to become a laminar steady flow.

The principle of transferring the energy developed by a powerful arc discharge to a gaseous mass brought to a high ionization temperature and made electrically conductive has become a reality in the field of electrothermal techniques for many years.

The use of the conductive gaseous mass so created, as a vector supporting a highly powerful electric current (for example 75 kilowatts between the torches) in order to bring the plasma or gaseous resistor to a high temperature (4500° to 5000° C.) is more recent (Belgian patent No. 623,218 of Oct. 4, 1962 with French priority of October 1961) and has developed into industrial applications in various fields such as in open air (Belgian patent No. 721,912 for heating a reactive fluid at high temperature) or in closed containers with conditioned atmospheres (Belgian Refining patent No. 778,913) or in open air (French patent for a melting furnace, French patent No. 1,488,206 of Apr. 11, 1963).

When the spread between the torches, whether arranged in convergence or in opposition, is relatively small (less than 50 cm) and/or when the dynamic power of the gaseous flow is sufficiently high, such applications do not present particular problems for striking, since the energetic superimposed circuit between the torches closes up nearly instantaneously (auto-striking).

This is no longer the case when working with torches located about 70 cm apart or more from each other, for example at the opposite ends of an elongated chamber, and if one attempts to create a laminar flow of plasma between them which excludes high steady speeds, one must then wait a particularly long time for the rate of ionization of the gaseous content in the enclosure to become sufficiently high to permit passage of a superimposed current and for high temperatures.

Such waiting will not only reduce considerably the efficiency of the ulterior operations (discontinued fusions or pouring for instance) but still can favor the formation of parasitic arcs as we shall later on see.

To shorten this striking phase, attempts have of course been made to bring the torches closer together during this phase (as already in practice to strike an arc or to transfer a plasma to an external part).

However, this technique offers serious difficulties sometimes. These difficulties happen when a plasma beam at high temperature must be created in a closed container or furnace between torches located outside the container in normal operation. The temporary introduction during the striking of the torch in the container necessitates an increase in the diameter of the orifice, resulting in a loss of heat by enlarged radiation when the torch is relocated normally, and also increases the risk of parasitic arcs toward non-insulated portions of the cup or truncated cone, the arcs damaging the cup and causing turbulence if the electric parameters are not suitable for the distance between the torches.

Such introduction is furthermore practically impossible in such cases as when the torches are not aligned along the axis of the orifice, when the enclosure is a rotary furnace requiring tight seals at the ends (French patent No. 1,405,958, French patent No. 1,488,206 and Belgian patent No. 793,937) and even locks (in the navigation sense) when they operate in conditioned atmospheres and also when such furnaces have orifices conditioned by the pouring procedure (tilting).

The process of the invention permits striking to be obtained in such containers for a high temperature plasma beam with superimposed current and with a steady laminar flow between the torches located outside the containers.

It consists while the plasma torches are kept stationary at their normal spread outside the container, in pushing a conductive stick-electrode of copper for example but preferably insulated at its periphery by a layer of alumina for example, through one of the orifices of the container towards a torch window located at the opposite orifice. With the arc internal to the latter torch already struck and the plasma flame of this torch already connected to the tip of the stick-electrode, the circuit of energetic superimposed current is closed in between the nozzle of this torch and the tip of the stick-electrode. The stick-electrode is then retracted slowly with the plasma flame getting longer in beam shape until the stick-electrode is pulled out of the container entirely. At this very moment the internal arc of the second torch is struck and its flame is directed toward the plasma beam coming out of the enclosure, while at the same time the superimposed electric current of the stick-electrode is deviated toward the nozzle of the second torch by a commutator.

A plasma beam with laminar flow is then hooked (a word of art) between the two torches and the passage of the superimposed current brings its temperature rapidly to its normal range (4500° – 5000°C) without disturbing its flow.

We are illustrating herein the process for an enclosure of a rotary furnace without restriction to such a furnace.

FIG. 1 is a schematic axial cross section showing a stick-electrode in starting position in an enclosure within the furnace.

FIG. II is a partial axial section showing three stages in the process.

FIG. III(*a*) is an enlarged axial section through the stick-electrode.

FIG. III(*b*) is a cross section of the stick-electrode on the line I–I'.

FIGS. IV, IV(*a*), and IV(*b*) illustrate in cross section an insulated closing bushing in various stages of retraction.

In FIG. I, 1 and 2 are plasma torches with internal arcs whose pilot circuits are not shown. They heat the enclosure of the furnace rotating around its axis according to the arrow and having an external wall comprising a cylindrical surface 3 and truncated conical ends 5, 5′ insulated from the cylindrical surface by insulating rings 4,4′.

The material to be fused, such as powder, granules and the like, is pressed against the wall 3 by the centrifugal force and forms progressively an auto-crucible as shown at 8.

A stick-electrode 6 is shown in the position of maximum pentration in line with the nozzle of the torch 1, the opposite orifice on which the torch 2 will enter being closed by a retractable wedge 7 of the stick-electrode, the detail being shown in FIG. IV. The space 70 around the electrode is shown in FIGS. 1 and 2.

The internal arc of the torch 1 is struck and the flame 9 is hooked to the tip of the stick-electrode, the electrical circuit 15 of the energetic superimposed current being connected at B to a contact collar 10 of the stick-electrode, (commutator A being positioned at the left) and the stick-electrode is progressively pulled out of the enclosure by lengthening the plasma beam as shown in FIG. II.

Handle 16 is on the stick.

Neither the parts in rotation or optionally the tilting of the furnace, nor the internal design of the torches, intervene in the described process and therefore they are not shown.

In FIG. II three successive steps of the development of the striking process are shown, at the start in FIG. II(*a*), near the middle in FIG. II(*b*) and after complete extraction of the stick in FIG. II(*c*).

One can see in this process the lengthening of the plasma beam, the closing of the wedge 7 applied against the inner face 5′ of the wall of the furnace and the hooking of the frame 9′ of the torch 2 to the plasma beam, coming out of the enclosure at the very moment when the circuit closes at contact A in the commutator toward the nozzle 2 and opens away from the stick.

The regular operation of the furnace now begins.

In FIG. III the design of the stick-electrode 6 has been shown to larger scale with the internal cooling and the peripheral insulation layer 61 of alumina for instance.

The annular body 62 of the stick-electrode may be copper for instance.

The cooling circuit 63 and 64 is connected by flexible hoses 12 and 13 to the pumping system and the outlet of the cooling liquid which may be water for instance.

The central core 65 of the stick-electrode may also be copper.

FIG. IV shows the detail of the operation of the closing bushing 11 which is retractable with a spreading ring 14.

FIG. IV(*a*) shows this before penetration.

FIG. IV(*b*) is at location after penetration has ended.

During the penetration the bushing 11 is pushed inward in a groove by the edge of the orifice. As soon as the edge has gone over, the springy ring 14 spreads out again and its position on the stick-electrode is such that at the end of the stroke, it is pressed against the wall 5′ to stay there during and after the retraction of the stick-electrode.

These seals which are of insulating material and small in size, do not reduce the diameter of the pouring orifice. As can be seen at FIG. IV(*b*), they pull out easily during pouring. In case it is desired, one may also absorb the insulated bushings by fused work material, for example refining flux.

The operation of the process claimed and the stick-electrode which is part of it permits striking under 400 volts and 30 amperes of current by the plasma beam, absorbing 40 kilowatts of power in normal operation and reaching temperatures of 4500° and 5000°C.

In view of our invention and disclosure, variations and modifications to meet individual whim or particular need will doubtless become evident to others skilled in the art, to obtain all or part of the benefits of our invention without copying the process and apparatus shown, and we therefore claim all such insofar as they fall within the reasonable spirit and scope of our claims.

Having thus described our invention, what we claim as new and desire to secure by Letters Patent is:

1. A process of striking a plasma beam at high temperature, which is practiced in an enclosure with two torches having nozzles and located at opposite ends of the said enclosure and outside said enclosure and windows associated with the torches, which comprises introducing a stick-electrode lengthwise through the window associated with one of the torches and brought near the opposite torch until the plasma hooks to the stick-electrode, thereby closing between the nozzle of the one torch and the stick-electrode a circuit of superimposed current, pulling the stick-electrode out progressively from the enclosure, carrying with it the plasma beam until it meets with a second torch which is energized at the very moment the extraction of the stick-electrode is completed, in order to transfer the superimposed current to its nozzle, and disconnecting the stick-electrode and closing the laminar plasma flow circuit.

2. The process of claim 1, in which the enclosure consists of a rotary furnace for plasma fusion and for refining a load of powdery or granular materials, which consists in rotating the furnace, pressing the load against the inside of the cylindrical wall of the furnace by centrifugal force, leaving free a central passage between the external torches, introducing the stick-electrode and proceeding to strike between the torches a plasma beam with superimposed current.

* * * * *